US008814127B2

(12) United States Patent
Sato

(10) Patent No.: US 8,814,127 B2
(45) Date of Patent: Aug. 26, 2014

(54) FIXING DEVICE AND ANTENNA DEVICE

(71) Applicant: Kyuichi Sato, Oga (JP)

(72) Inventor: Kyuichi Sato, Oga (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 160 days.

(21) Appl. No.: 13/644,164

(22) Filed: Oct. 3, 2012

(65) Prior Publication Data

US 2013/0082158 A1 Apr. 4, 2013

(30) Foreign Application Priority Data

Oct. 3, 2011 (JP) ..... 2011-219561

(51) Int. Cl.

| | |
|---|---|
| ***A01K 97/10*** | (2006.01) |
| ***A45B 25/28*** | (2006.01) |
| ***A47G 25/12*** | (2006.01) |
| ***A47G 33/12*** | (2006.01) |
| ***H01Q 1/12*** | (2006.01) |
| ***H01Q 1/32*** | (2006.01) |

(52) U.S. Cl.

CPC ..... *H01Q 1/1214* (2013.01); *H01Q 1/3275* (2013.01)

USPC ..... 248/536; 248/534; 248/535; 343/711; 343/713

(58) Field of Classification Search

CPC ..... H01Q 1/3275; H01Q 1/1214

USPC ..... 248/534, 535, 536; 343/711, 713

See application file for complete search history.

(56) References Cited

U.S. PATENT DOCUMENTS

| | | | | |
|---|---|---|---|---|
| 2005/0237248 | A1* | 10/2005 | Nakano et al. | 343/711 |
| 2011/0017899 | A1* | 1/2011 | Lerchner | 248/534 |
| 2011/0226927 | A1* | 9/2011 | Sato et al. | 248/534 |
| 2011/0267243 | A1* | 11/2011 | Steinkamp et al. | 343/713 |
| 2013/0112837 | A1* | 5/2013 | Spagnolo et al. | 248/535 |
| 2014/0043193 | A1* | 2/2014 | Gerneth et al. | 343/713 |

FOREIGN PATENT DOCUMENTS

| | | | |
|---|---|---|---|
| JP | 2009-528487 | A | 8/2009 |
| WO | WO 2009/143905 | A1 | 12/2009 |

* cited by examiner

*Primary Examiner* — Amy Sterling

(74) *Attorney, Agent, or Firm* — Holtz Holtz Goodman & Chick PC

(57) ABSTRACT

A fixing device of an antenna device includes a base member, a fixing member, a bolt and a guide which guides the base member to a fixing opening. The fixing device takes a main fixed state in which the mounting surface is clamped between the fixing member and the base member after inserting the fixing member into the fixing opening and rotating the fixing member at a predetermined angle, and an initial fixed state in which the fixing device is fixed before the fixing member is rotated at the predetermined angle. The guide is arranged at a position to surround the fixing member in the initial fixed state, and includes guide portions which have greater height than that of a lower end of the fixing member in the initial fixed state.

7 Claims, 17 Drawing Sheets

FIXING DEVICE AND ANTENNA DEVICE

BACKGROUND OF THE INVENTION

1. Field of the Invention

This invention relates to a fixing device that fixes an antenna portion on a mounting surface, and to an antenna device provided with the fixing device.

2. Description of the Related Arts

Heretofore, as an antenna device mounted onto an automobile roof and the like, the one capable of receiving a radio wave of multiple frequency bands used for Global Positioning System (GPS), satellite radio broadcasting, AM/FM radio broadcasting, telephone, television broadcasting and so on is generally known. The antenna device is fixed by an appropriate method after a fixing portion provided on the bottom surface thereof is inserted into a fixing hole (fixing opening) having a substantially square shape provided on a mounting surface of the automobile roof and the like.

An antenna holder is known, for fixing and mounting an antenna base of the antenna device on the automobile roof, which includes: an anchor claw having four arms curved into an S-shape; a spreading element for spreading the arms; a screw (bolt); and a socket portion attached to the antenna base (refer to Japanese Patent Application Laid-Open Publication (Translation of PCT Application) No. 2009-528487). The anchor claw and the spreading element respectively have penetration openings. The antenna holder is set to an initial state before deformation of the arms when the screw penetrates the penetration openings and is tightened halfway on the antenna base.

The socket portion has a shape to contact the inner side of the fixing opening of the automobile roof. In the initial state, the anchor claw, the spreading element, the screw and the socket portion are configured to become smaller in area than the fixing opening. The anchor claw, the spreading element and the screw in the initial state of the antenna holder are penetrated through the fixing opening, the socket portion is fitted in the fixing opening, and the screw is tightened further. By this, the four arms of the anchor claw spread and are bent while being deformed. The plural bent arms and the antenna base clamp the automobile roof, thereby fixing the antenna holder on the automobile roof.

Furthermore, an antenna holder in which arms do not deform is known (refer to International Publication No. 2009-143905). The antenna holder includes: a supporting portion having four L-shaped arms which do not deform; a screw (bolt); rotation inhibiting portions for the screw; and four guide portions attached to the antenna base. The supporting portion and rotation inhibiting portion for the screw respectively have penetration openings. The screw penetrates the penetration openings and is tightened halfway on the antenna base to set the antenna holder to an initial fixed state in which positions of the arms are fixed with respect to the antenna base. The rotation inhibiting portions are members that restrict the rotation of the supporting portion in association with rotation of the screw. Also, the rotation inhibiting portions are structured to lock a rotation position of the supporting portion in the initial fixed state.

The guide portions are provided at positions that contact the inner side of the fixing opening of the automobile roof. In the initial fixed state, the arms of the supporting portion are configured to be respectively positioned on diagonal lines of the fixing opening so that the area including the supporting portion, the rotation inhibiting portions and the screw become smaller than the area surrounded by the guide portions (fixing opening). The supporting portion, the border fixing portion and the screw in the initial state of the antenna holder are penetrated through the fixing opening, the guide portions are fitted in the fixing opening, the supporting portion is rotated to position the arms thereof at the center lines of four sides of the fixing opening, and the screw is tightened further. By this, the four arms moves towards the antenna base, and the four arms and the antenna base clamp the automobile roof and fix the antenna holder onto the automobile roof.

However, in the conventional antenna holder with arms which do not deform, the upper ends of the guide portions are positioned lower than the lower ends of the arms in the vertical direction of the roof in the initial fixed state. This allows the arms to be easily affected by impact from the outside. The impact may cause a risk of the arms being projected out of the region surrounded by the guide portions when the arms rotate and disconnect the locking state and releases the initial fixed state.

The impact from outside includes vibration of the antenna holder while being transported and external force applied by an operator while the antenna being mounted onto the automobile roof. When the initial fixed state is released, the assembly operator needs to reset the antenna holder to the initial fixed state before mounting the antenna holder onto the automobile roof through the fixing opening. This may cause a complication in the operation.

Furthermore, when attaching the antenna holder onto the fixing opening, the attaching operation may become difficult as a periphery of the fixing opening get caught between the arms and the guide portions, causing the position of the antenna holder to become shifted with respect to the fixing opening.

SUMMARY OF THE INVENTION

The present invention aims to easily mount the antenna device on the mounting surface and to shorten the time taken for mounting operation.

According to an aspect of the present invention, there is provided a fixing device for fixing an antenna device through a fixing opening provided on a mounting surface, comprising:

a base member;

a fixing member which has a shape that is inserted into the fixing opening and that is abutted against a periphery of the fixing opening; and a guide which guides the base member to the fixing opening, wherein the fixing device takes:

a main fixed state in which the mounting surface is clamped between the fixing member and the base member by means of inserting the fixing device into the fixing opening and rotating the fixing member at a predetermined angle; and an initial fixed state in which the fixing member is initially fixed with respect to the base member before the fixing member is rotated at the predetermined angle, and the guide is arranged at a position to surround the fixing member in the initial fixed state, and includes plural guide portions which have greater height than that of a lower end of the fixing member in the initial fixed state, regarding the height from the base member.

Preferably, the base member has a nut portion formed thereon, the fixing device includes a bolt which is screwed to the nut portion in a state such that the bolt is inserted into the fixing member, the fixing member includes rotation inhibiting portions which respectively have recessions on a periphery thereof and are shaped towards the base member, the base member includes: engagement holes each of which engages with each of the rotation inhibiting portions when the bolt is screwed to the nut portion; protrusions each of which engages with each of the recessions; and step portions each of which are connected to each of the engaging holes, in the initial fixed state, the fixing member is fixed and held in a manner such that the fixing member abuts against the step portions in a beginning of screwing the bolt to the nut portion in which the recessions engage with the protrusions, and the fixing device is inserted into the fixing opening in the initial fixed state, and when the bolt is tightened to the nut portion and the fixing member is rotated in association therewith, the recessions or the protrusions elastically deform to release the initial fixed state, and after the fixing member being rotated at the predetermined angle, each of the rotation inhibiting portions engage with each of the engaging holes by fastening the bolt, making the fixing member clamp the mounting surface with the base member and be fixed, and the fixing device is set to the main fixed state.

Preferably, the guide is made of resin.

Preferably, the guide includes plural projection portions which are provided on an outer periphery of the guide and contact an inner side of the fixing opening when the antenna device is mounted onto the mounting surface.

Preferably, the guide portions are arranged at positions that restrict a rotation of the fixing member at the predetermined angle.

Preferably, the fixing member has:

a rotation axis portion; and plural leg portions which are extended radially from the rotation axis portion and are respectively curved towards the base member, and length from a center of the rotation axis portion to each of tips of the leg portions corresponds to length from a center to each of vertices of the fixing opening.

According to another aspect of the present invention, there is provided an antenna device comprising:

the fixing device according to claim 1; and an antenna body.

The present invention achieves, by use of the guide (guide portions), easy mounting of the antenna device on the mounting surface (fixing opening) and shortening of the time taken for the mounting operation.

DESCRIPTION OF THE PREFERRED EMBODIMENTS

Figure 1:
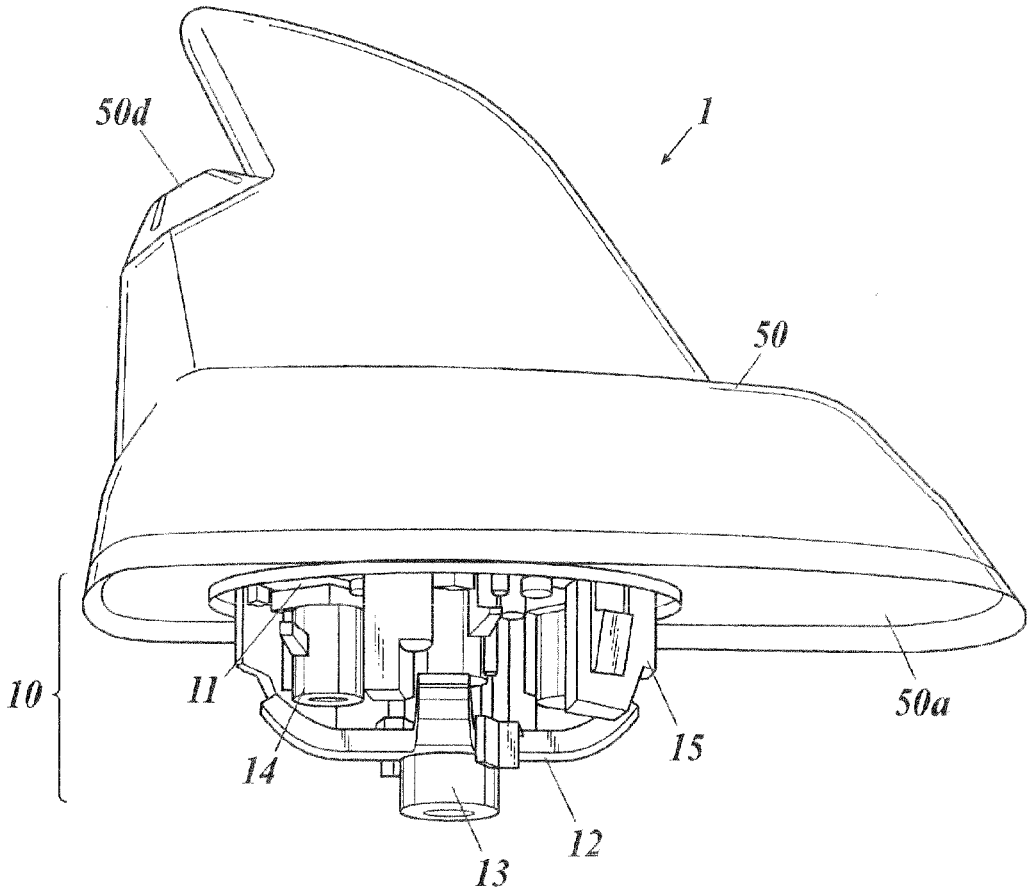
FIG. 1 is an external view of an embodiment of an antenna device according to the present invention.

Hereafter, an embodiment of the present invention will be described with reference to the drawings. However, the present invention is not limited to the exemplars shown in the drawings.

FIG. 1 is an external view showing an antenna device 1 according to an embodiment. The antenna device 1 shown in FIG. 1 is an antenna device capable of receiving a radio wave of multiple frequency bands used for Global Positioning System (GPS), satellite radio broadcasting, AM/FM radio broadcasting, telephone, television broadcasting and so on, and is fixed onto a mounting surface 60 of an automobile (vehicle) roof and the like.

As shown in FIG. 1, the antenna device 1 of the embodiment includes: an antenna body 50 for housing an antenna substrate on which an antenna pattern and a patch antenna are mounted; and a fixing device 10 for fixing the antenna device 1 onto the mounting surface. The antenna body 50 has a rod antenna attaching portion 50*d* for attaching a rod antenna. Although not shown, the rod antenna may be attached to the antenna attaching portion 50*d*. The fixing device 10 includes: a base member 11 provided in a protruding manner from a protecting member 50*a* provided on the bottom surface of the antenna body 50; a fixing member 12 for clamping the mounting surface 60 with the base member 11 on the bottom surface of the antenna body 50; a bolt 13 which is tightened on the base member 11 in a state such that the fixing member 12 is penetrated therethrough; a guide 15 for guiding the fixing device 10 to a fixing opening 60*a* described later. Also, the base member 11 has connector portions 14 arranged thereon for connecting wires to electronic devices in the vehicle.

Figure 2:
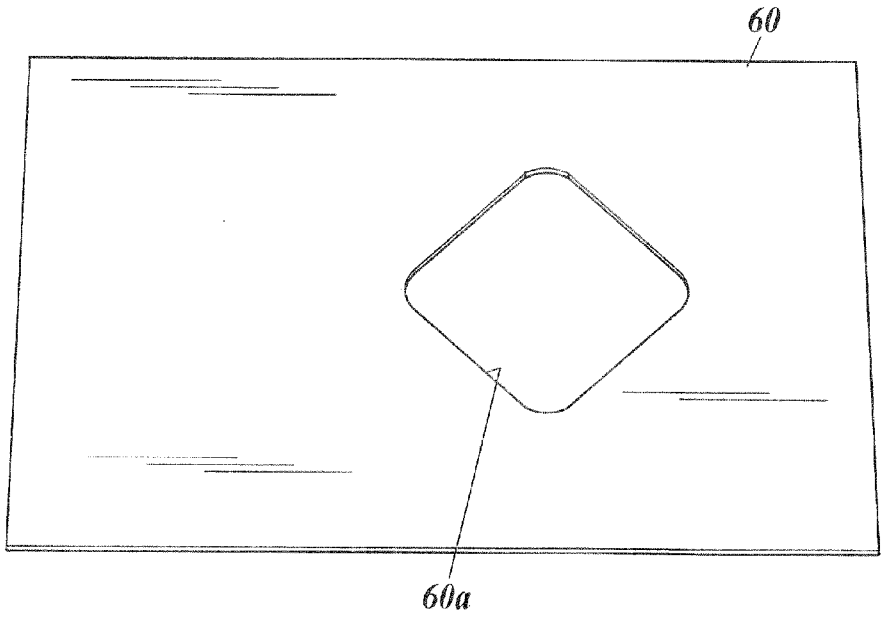
FIG. 2 is a view showing a part of a mounting surface of the antenna device.

FIG. 2 is a view showing a part of the mounting surface 60 (for example, the automobile roof) of the antenna device 1. As shown in FIG. 2, the fixing opening 60*a* which has a substantially square shape is formed on the mounting surface 60.

Figure 3:
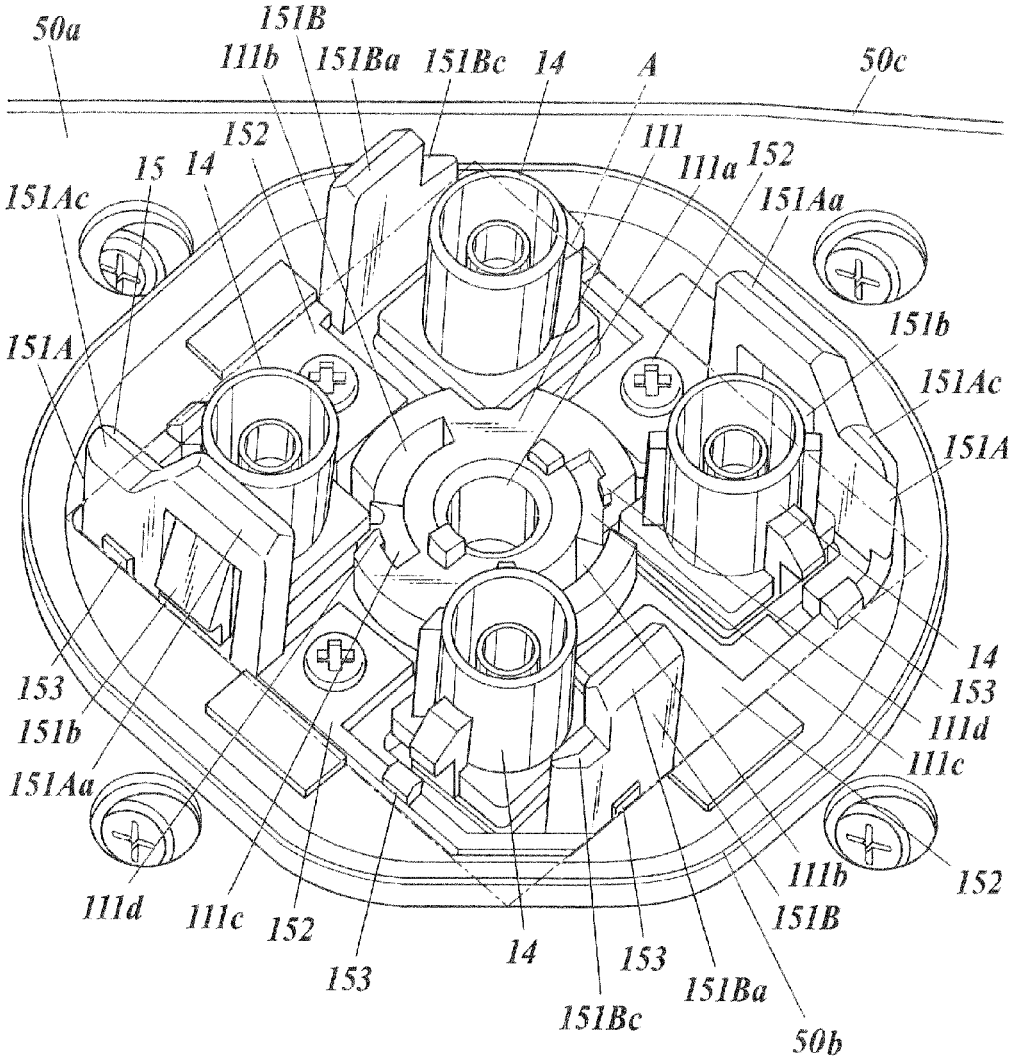
FIG. 3 is a view showing a structure of a base member.
Figure 4:
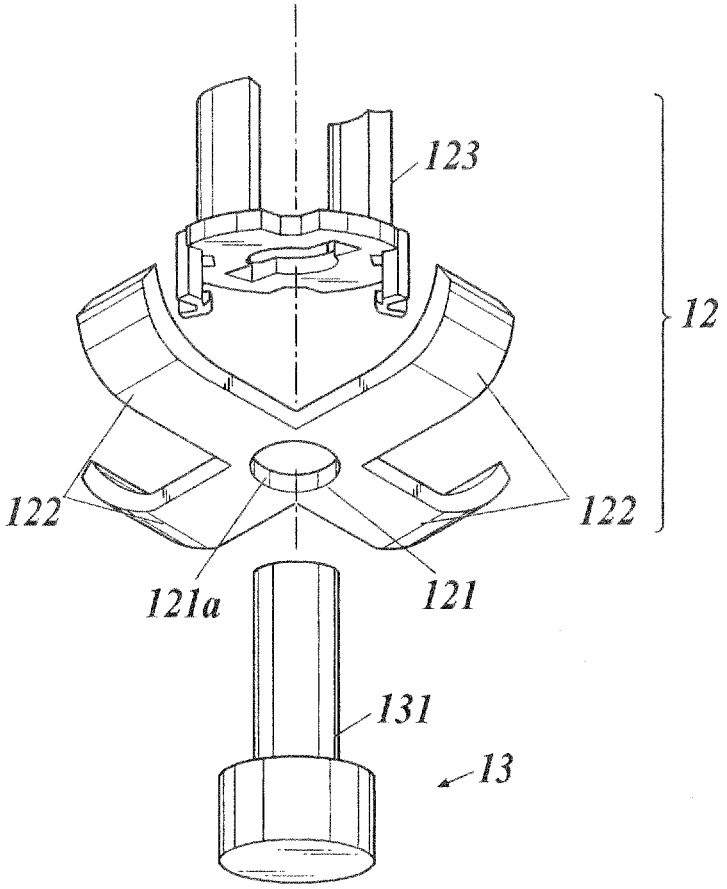
FIG. 4 is an exploded view of a fixing member and a bolt.

FIG. 3 is a view showing a structure of the base member 11. FIG. 4 is an exploded view of the fixing member 12 and the bolt 13. As shown in FIG. 3, the base member 11 is fixed to the protecting member 50*a* to face the outside from the substantially square opening formed on the protecting member 50*a* on the bottom surface of the antenna body 50. The base member 11 is made of metal such as zinc die-cast, aluminum die-cast and the like. The guide 15 is made of resin such as plastic, and for example, monolithically molded. The protecting member 50*a* is made of elastic body such as rubber. Here, the protecting member 50*a* of the antenna body 50 and the base member 11 may be molded integrally by insert molding of the base member 11 and configured as an integral member.

At the center of the base member 11, a nut portion 111 having a cylindrical shape is formed, and in the nut portion 111, a female screw 111*a* to be screwed with the bolt 13 is formed. On the nut portion 111, at opposing positions across the female screw 111*a*, engaging holes 111*b* are formed each of which engages with each of rotation inhibiting portions 123 (described later). Further, each of the engaging holes 111*b* has a step portion 111*c* being connected thereto. The step portions 111*c* are formed shallower than the engaging holes 111*b*. On a side wall of each of the step portions 111*c*, a protrusion 111*d* is formed. Each of the protrusions 111*d* engage with each of recessions 123*a* (described later) of the rotation inhibiting portions 123.

In the region having the nut portion 111 of the base member 11 as a center, the guide 15 having a substantially rectangular loop shape is provided. The guide 15 includes guide portions 151A, 151B, connecting portions 152 and projections 153.

The guide portions 151A, 151B are respectively formed on the four side edges of the guide 15 in a manner that surrounds the nut portion 111. The guide portions 151A, 151B have substantially rectangular parallelepiped (plate) shapes and guide the fixing device 10 to a position of the fixing opening 60*a*. The two guide portions 151A are respectively arranged on two of the opposing sides of the guide 15, and the two guide portions 151B are respectively arranged on two of the opposing sides of the guide 15. The guide portions 151A, 151B are connected by the four connecting portions 152. Also, the two projections 153, which contact the inner side of the fixing opening 60*a* when mounting the antenna device 1 (fixing device 10) onto the mounting surface 60 (fixing opening 60*a*), are provided on the outer periphery of each of the four sides of the guide 15. This means that there are total of eight projections 153.

An outline A of the protruded portion of the base member 11, which is specified by the guide portions 151A, 151B and the projections 153, has a substantially equal shape with the fixing opening 60*a* of the mounting surface 60. Thus, when the antenna device 1 is fixed onto the mounting surface 60, the base member 11 is fitted into the fixing opening 60*a*.

Each of the guide portions 151A includes a guide portion body 151Aa having maximum height from the base member 11 (length in a perpendicular direction to the plane of the base member 11 or in an axis direction of the bolt 13). Each of the guide portions 151B includes a guide portion body 151Ba having maximum height from the base member 11. The guide portion bodies 151Aa and 151Ba have the same height. The guide portion bodies 151Aa and 151Ba are arranged at positions to function as regulating pieces for regulating the fixing member 12 from rotating in a tightening direction of the bolt 13.

In each of the guide portions 151A, a hook 151*b* for clamping the mounting surface 60 with the base member 11 is formed. Each of the guide portions 151A includes a cut-off portion 151Ac on which apart of a tip end of each of leg portions 122 of the fixing member 12 in an initial fixed state (described later) of the fixing device 10 is arranged. Likewise, each of the guide portions 151B includes a cut-off portion 151Bc on which a part of a tip end of each of the leg portions 122 of the fixing member 12 in an initial fixed state of the fixing device 10 is arranged.

A pair of guide portions 151B has a slimmed down shape with no hooks provided thereon. For this reason, the antenna device 1 can be configured simply and reduced in weight.

Moreover, the hooks 151*b* are made of resin, simplifying the temporal mounting (temporal fixing) of the antenna device 1 on the mounting surface 60 using the hooks 151*b*. Particularly, the antenna device 1 can be easily detached using the hooks 151*b* when the hooks 151*b* are pushed down in the temporal fixing state of the antenna device 1 on the mounting surface 60.

The guide 15 is fixedly provided on the base member 11 by tightening screws at the four connecting portions 152. However, the configuration is not limited to this, and for example, the configuration may be used, in which the guide 15 is fixedly provided on the base member 11 by providing fusing holes on the base member 11 and fusing protrusions on the guide 15, inserting the fusing protrusions in the fusing holes, and fusing the two together.

In the base member 11, connector portions 14 for connecting the wires are respectively arranged in four regions. The four regions are formed by dividing the region of the base member 11 by the four connecting portions 152 with the nut portion 111 positioned at the center. Here, the number of the connector portions is set to four; however, the number is not limited to this.

Ribs 50*b* and 50*c* are formed on the protecting member 50*a*. The rib 50*b* is formed, for example, in a flat shape made by combining plural rectangles so that the base member 11 is exposed. The rib 50*c* is formed on a periphery of the bottom surface of the antenna body 50. The ribs 50*b* and 50*c* have waterproof and dustproof properties which prevent water, dust and the like to enter into the antenna body 50, fixing device 10 and mounting surface 60 from the outside after the antenna device 1 is mounted onto the mounting surface 60. Also, the rib 50*b* has a substantially circular flat shape. Thus, the protecting member 50*a* of the antenna device 1 can have a simple configuration and because stress applied on the rib 50*b* becomes substantially uniform after the antenna device 1 is mounted onto the mounting surface 60, the waterproof and dustproof effect can be enhanced.

As shown in FIG. 4, the fixing member 12 includes: a rotation axis portion 121 on which an insertion hole 121*a* for inserting the bolt 13 therethrough is formed; leg portions 122 which are extended radially from the rotation axis portion 121 in four directions where each of which makes 90 degrees with the adjacent legs, and curves in an arch towards the base member 11; and the rotation inhibiting portions 123 which restrict the fixing member 12 from rotating in association with the bolt 13 when tightening the bolt 13.

The rotation axis portion 121 and leg portions 122 are formed integrally, and for example, fitting made of metal. A length from the rotation axis portion 121 to each of the tips of the leg portions 122 is set so that: the fixing member 12 can be inserted into the fixing opening 60*a* of the mounting surface 60; and the tips of the leg portions 122 are positioned on the periphery (mounting surface 60) of the fixing opening 60*a* when the fixing member 12 is rotated from a state of being inserted into the fixing opening 60*a*.

For example, the length from the rotation axis portion 121 to each of the tips of the leg portions 122 on a plane is formed to correspond to a length from center to vertex of the fixing opening 60*a* of the mounting surface 60. That is, the rotation axis portion corresponds to the center of the fixing opening 60*a* and the two straight line formed by the four leg portions 122 corresponds to a diagonal line of the fixing opening 60*a*.

By this configuration, the fixing member 12 can be inserted from the fixing opening 60*a*, and when the fixing member 12 is rotated about an axis center of the bolt 13, the tips of the leg portions 122 of the fixing member 12 are always positioned on the periphery of the fixing opening 60*a*. Further, the fixing opening 60*a* is formed in a substantially square shape, and because the lengths of the four leg portions 122 of the fixing member 12 are the same, the mounting surface 60 is uniformly supported to achieve a stable fixed state. Still further, designing of the base member 11 and the fixing member 12 is simplified.

As described in the description of the related arts, in the conventional antenna holder which uses the arms which do not deform, the arms of the supporting portion are L-shaped respectively and extended lines towards tip directions intersect with a plane of the antenna base at a right angle. This causes force applied by the arms to the antenna base to act only in the vertical direction with respect to the plane of the antenna base. Thus, when mounting the antenna holder onto the automobile roof, the arm tips exert large force in the vertical direction of the automobile roof depending on tightening speed and force of the screw, applying large stress on the automobile roof. This may cause a risk of damaging and deforming the automobile roof.

On the other hand, the leg portions 122 of the embodiment are curved, and extended lines from the rotation axis portion 121 towards the tip directions of the leg portions 122 intersect with the plane of the base member 11 at an angle smaller than the right angle. Therefore, when tightening the bolt 13, force applied by the leg portions 122 to the base member 11 disperses in the vertical and horizontal directions with respect to the plane of the base member 11. When mounting the fixing device 10 onto the mounting surface 60, stress applied on the mounting surface 60 by the tips of the leg portions 122 is reduced, even when the tightening speed and force of the bolt 13 are large. This prevents damaging and deforming of the mounting surface 60.

The rotation inhibiting portions 123 are made of resin material for example, and formed longer than the height of the leg portions 122 (length of the bolt 13 in the axis direction). The rotation inhibiting portions 123 are configured separately from the metal fitting formed of the rotation axis portion 121 and leg portions 122, and is engaged to forks of the leg portions 122. Here, the metal fittings and the rotation inhibiting portions 123 may be molded integrally by insert molding, or may be configured using the same material as a single member by metal press molding.

The bolt 13 has a male screw 131 formed thereon which screws with the female screw 111*a* formed in the nut portion 111 of the base member 11. The fixing device 10 is configured by screwing the bolt 13 with the nut portion 111 of the base member 11 in a state such that the bolt 13 is inserted into the fixing member 12.

Figure 5:
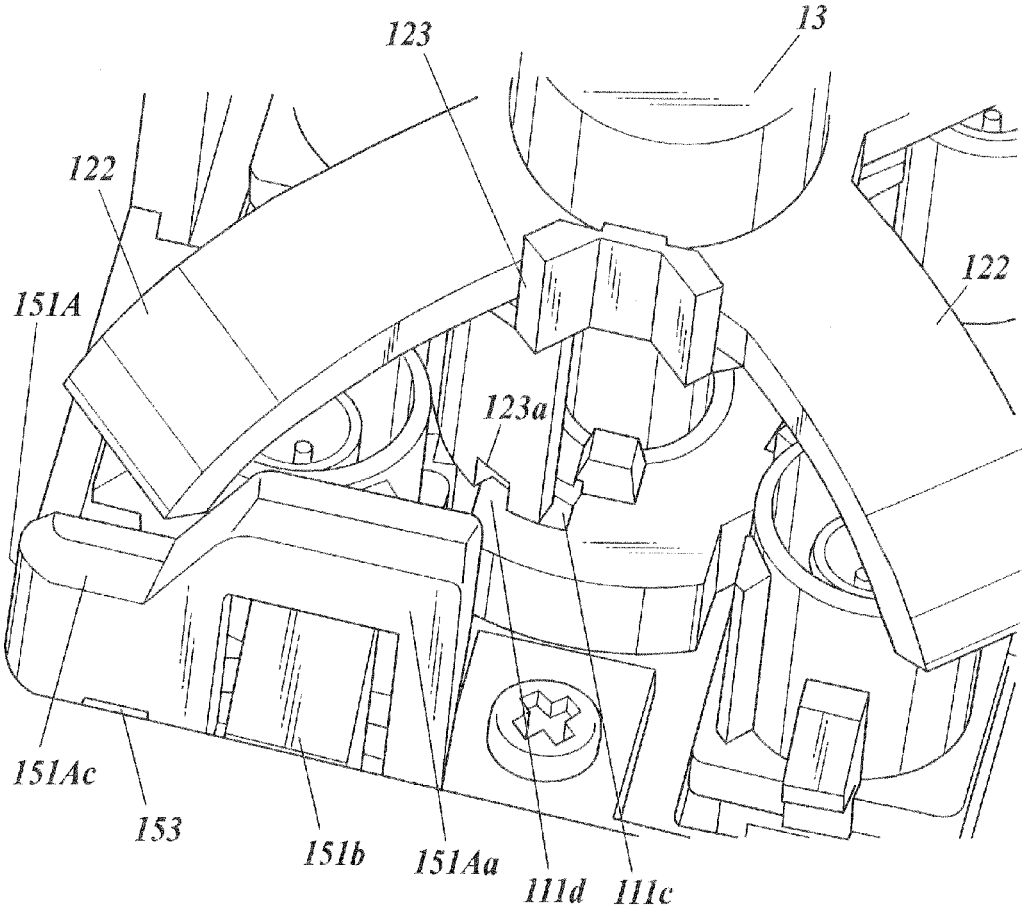
FIG. 5 is an enlarged view showing a structure of a fixing device.

FIG. 5 is an enlarged view showing a structure of the fixing device 10. As shown in FIG. 5, in the beginning of screwing, each of tips of the rotation inhibiting portions 123 is positioned on each of the step portions 111*c* of the nut portion 111. Each of the leg portions 122 is positioned at a point corresponding to the diagonal lines of the outline A of the guide 15 (the guide portions 151A, 151B and the projections 153) of the base member 11. At this time, each of the protrusions 111*d* formed on the nut portion 111 and each of the recessions 123*a* formed on the rotation inhibiting portions 123 are engaged, so that the fixing member 12 is set to an initially fixed (locked) state with respect to the base member 11.

The fixing member 12 is not easily rotated in the locked state, but this locked state is easily released by strong rotational stress applied by electric tools and the like. The fixing device 10 (antenna device 1) in a state when the fixing member 12 in this locked state is defined as an initial fixed state (of the fixing member 12). The antenna device 1 is shipped out from a factory in the initial fixed state, and delivered to an assembly plant of an automobile manufacturer. The antenna device 1 is mounted onto the mounting surface 60 by an operator in the assembly plant.

Figure 6:
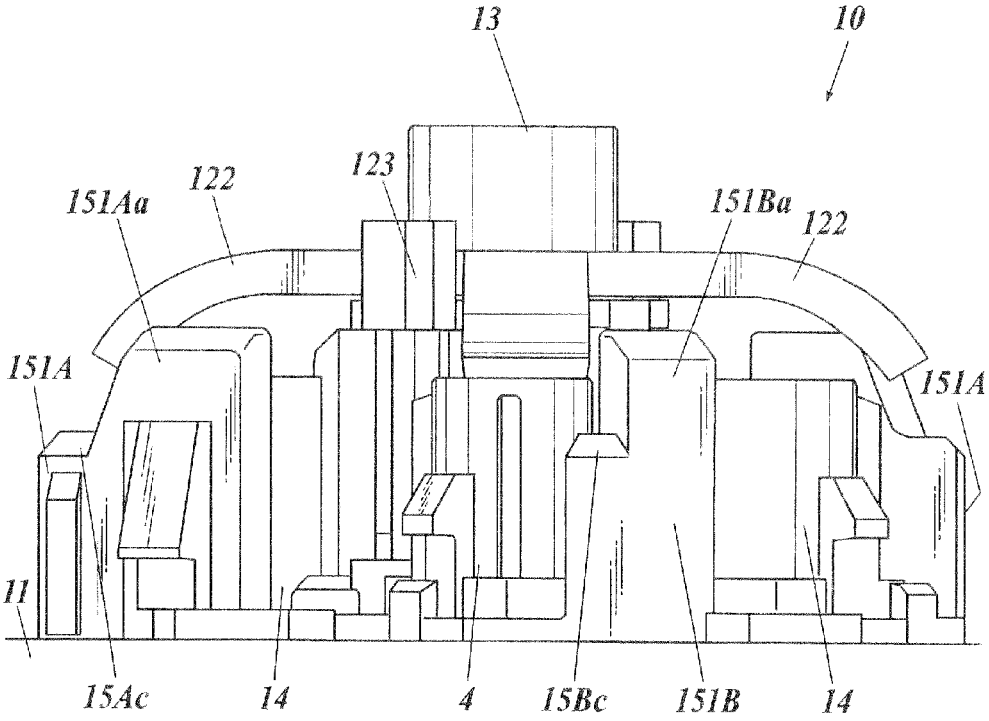
FIG. 6 is a side view of the fixing device in an initial fixed state.
Figure 7:
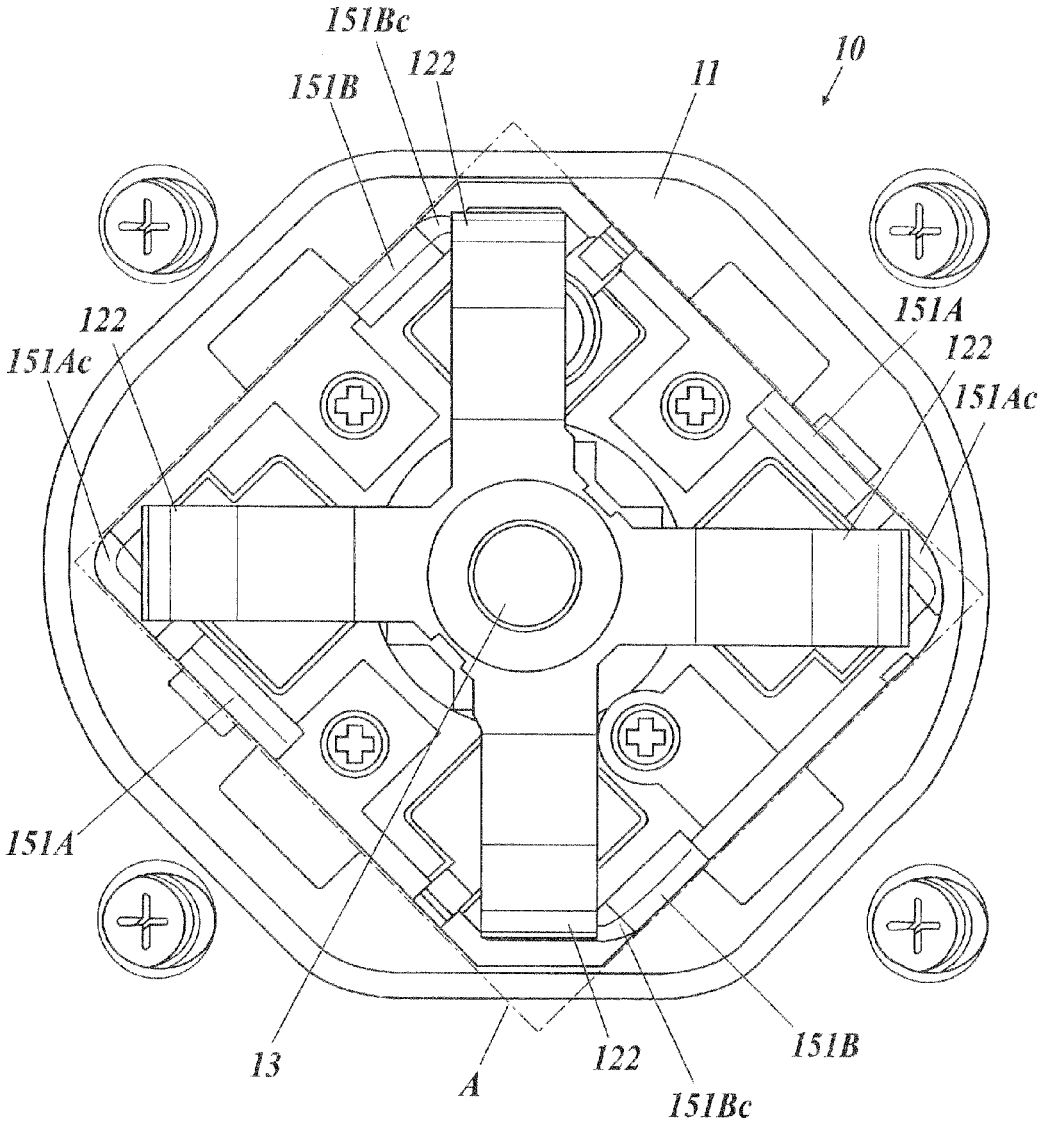
FIG. 7 is a plan view of the fixing device in the initial fixed state.

FIG. 6 is a side view of the fixing device 10 in the initial fixed state. As shown in FIG. 6, in the fixing device 10 in the initial fixed state, the height of the guide portions 151A, 151B (the guide portion bodies 151Aa, 151Ba) from the plane of the base member 11 is greater than the height of the tips of the leg portions 122 (i.e., the length in the axis direction of the bolt 13 is greater). The height of the guide portions 151A, 151B from the plane of the base member 11 is 12 to 17 mm, for example. Further, as shown in FIG. 7, in the fixing device 10 in the initial fixed state, the guide portions 151A, 151B (the guide portion bodies 151Aa, 151Ba) are arranged at positions which surround the fixing member 12, that is, positions that contact the outline A from the inside. For this reason, the guide portions 151A, 151B prevent the fixing member 12 to be subjected to impact from the outside in the fixing device 10 in the initial fixed state.

In other words, in the fixing device 10 in the initial fixed state, the guide portions 151A, 151B prevent the leg portions 122 to be projected out from the outline A after the locked state made by the protrusions 111*d* and recessions 123*a* is released to rotate the fixing member 12, by the impact from the outside such as vibration at the time of transportation and external force applied by the operator at the time of assembly. When the leg portions 122 project out from the outline A, the fixing member 12 and the guide 15 of the fixing device 10 cannot be inserted into the fixing opening 60*a*, so the operator needs to reset the fixing device 10 (antenna device 1) to the initial fixed state. However, with this configuration, the reset operation becomes unnecessary.

Moreover, the height of the guide portion bodies 151Aa, 151Ba is greater than that of the tips of the leg portions 122. This prevents the periphery of the fixing opening 60*a* in the initial fixed state to get caught between the guide portions 151A, 151B (guide portion bodies 151Aa, 151Ba) and the fixing member 12 (leg portions 122). In the conventional antenna holder, when the periphery of the fixing opening gets caught between the guide portions and the arms, the operator needs to perform a correction operation in which the periphery is taken out from between the guide portions and the arms because the antenna holder becomes shifted with respect to the fixing opening. However, in the fixing device 10 (antenna device 1) of the embodiment, the correction operation becomes unnecessary.

FIG. 7 is a plan view of the fixing device 10 in the initial state. As shown in FIG. 7, in the fixing device in the initial state, the leg portions 122 are positioned inside the outline A. At this time, the tips of the leg portions 122 are partially positioned on the cut-off portions 151Ac and 151Bc respectively.

Figure 8:
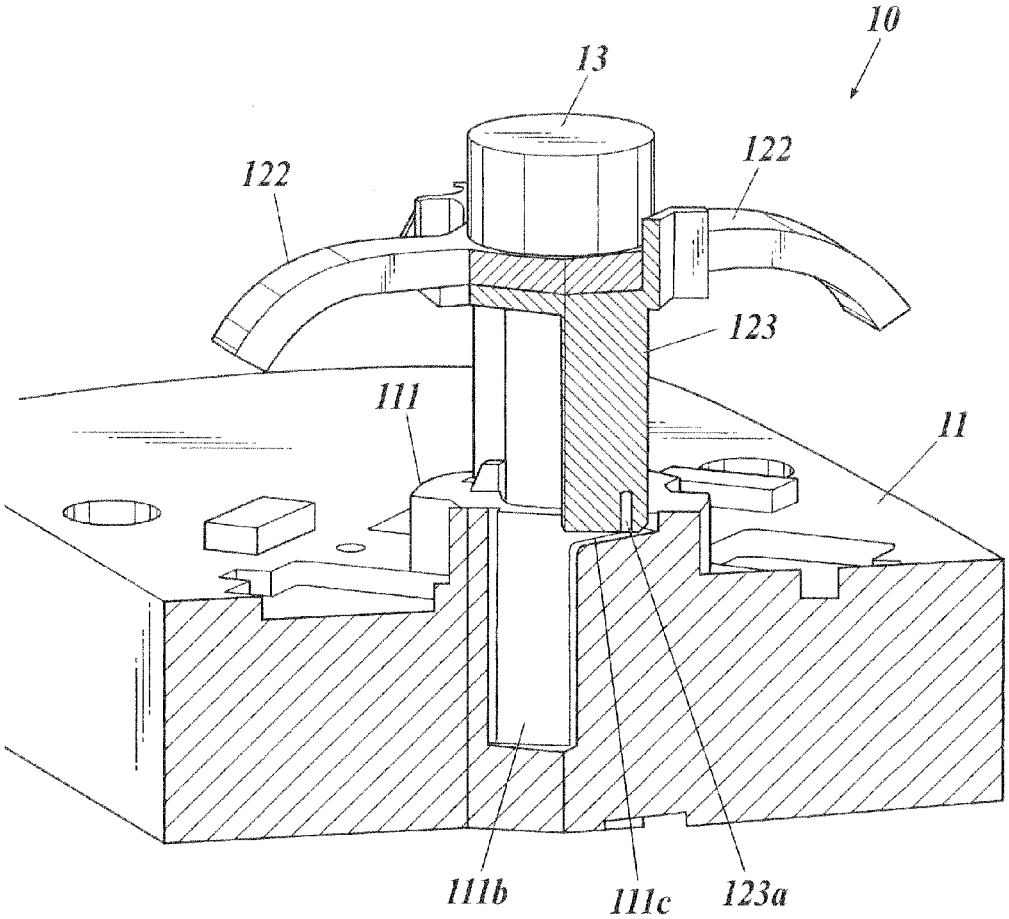
FIG. 8 is a partial cross-sectional view showing the structure of the fixing device in the initial fixed state.
Figure 9:
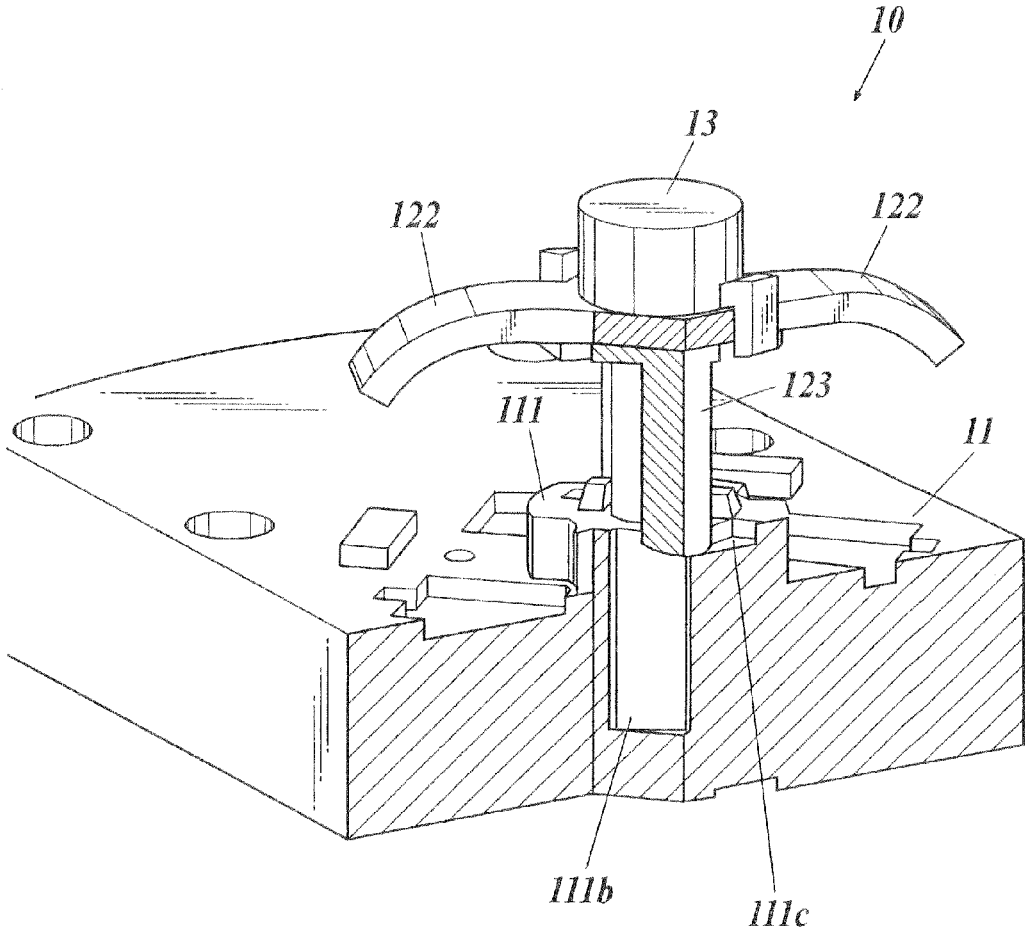
FIG. 9 is a partial cross-sectional view showing the structure of the fixing device when the fixing member is in a rotational state.
Figure 10:
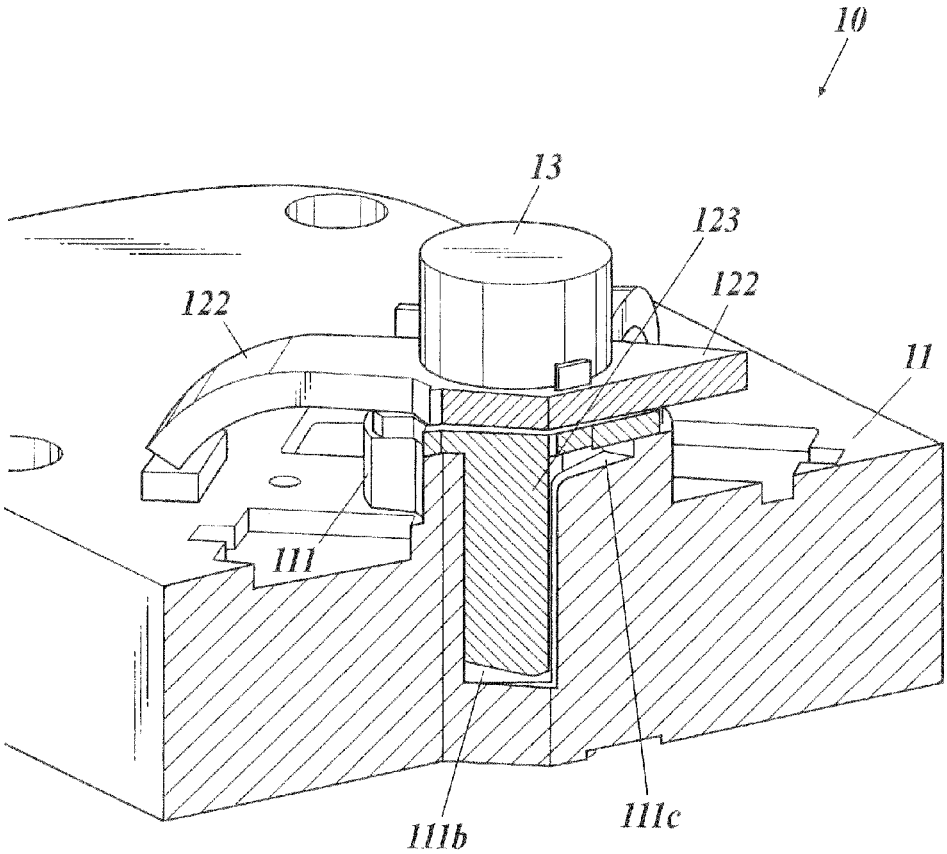
FIG. 10 is a partial cross-sectional view showing the structure of the fixing device when the fixing member is in a main fixed state.
Figure 11:
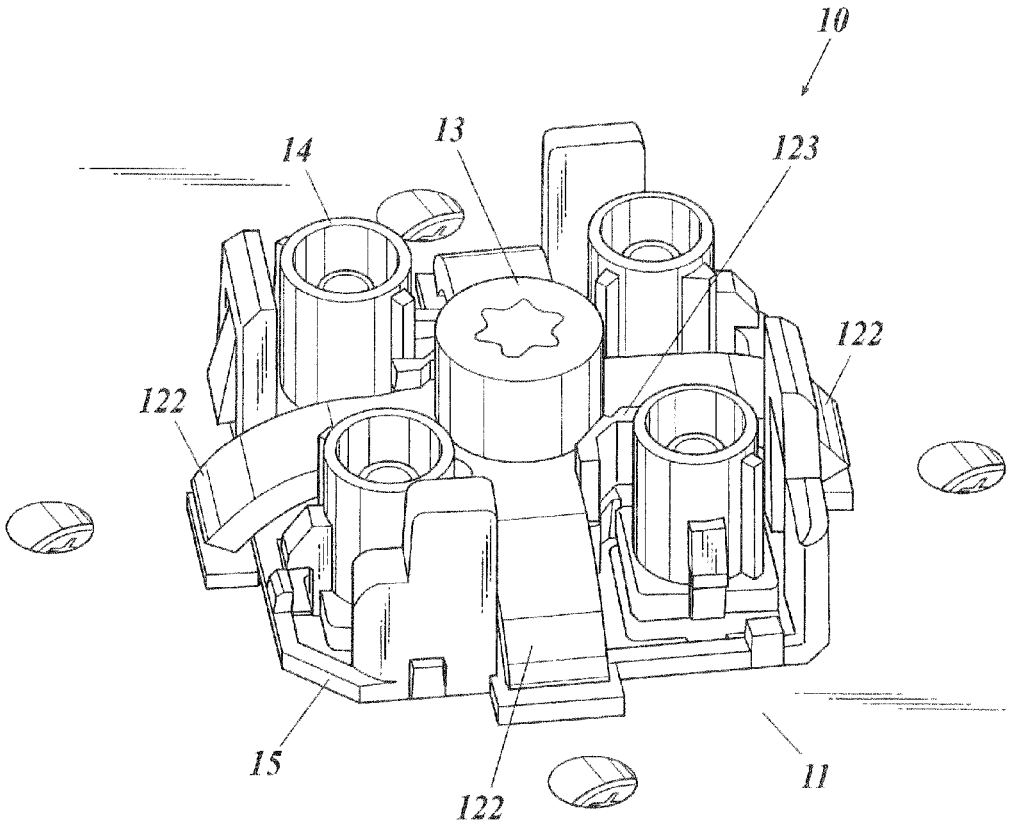
FIG. 11 is a perspective view of the fixing device when the fixing member is in the main fixed state.

FIG. 8 is a partial cross-sectional view showing the structure of the fixing device 10 in the initial fixed state. FIG. 9 is a partial cross-sectional view showing the structure of the fixing device 10 when the fixing member 12 is in a rotational state. FIG. 10 is a partial cross-sectional view of the fixing device 10 when the fixing member 12 is in a main fixed state. FIG. 11 is a perspective view of the fixing device 10 when the fixing member 12 is in the main fixed state. In FIGS. 8 to 10, the partial cross-sectional views of the antenna device 1 being cut off at a curve which passes the step portions 111*c* are shown, and the guide 15 is omitted.

As shown in FIG. 8, in the antenna device 1 (fixing device 10) in the initial fixed state, each of the rotation inhibiting portions 123 is abutted against and held in the step portion 111*c* by engagement of the step portion 111*c* and the recession 123*a*. The height from the base member 11 to the leg portions 122 in the initial fixed state is the highest among all the other states of the fixing device 10.

Then, as shown in FIG. 9, when strong force is applied by the electric tools and the like in the rotational direction (clockwise) of tightening the bolt 13, the bolt 13 is tightened to the nut portion 111 of the base member 11, the fixing member 12 rotates in association therewith, and with the rotation, the engagement of the step portions 111*c* with the respective recessions 123*a* is broken and the locked state is released. Thus, the fixing member 12 of the antenna device 1 (fixing device 10) is set to the rotational state. When the fixing member 12 is in the rotational state, the leg portions 122 rotate about the rotation axis portion 121.

Thereafter, as shown in FIGS. 10 and 11, the bolt 13 is further tightened, and when the fixing member 12 further rotates in the rotational state, the rotational movement of the leg portions 122 is restricted by the guide portion bodies 151Aa, 151Ba. Positions in which the rotation of the fixing member 12 is restricted by the guide portion bodies 151Aa, 151Ba correspond to positions in which the rotation inhibiting portions 123 are respectively engaged with the engaging holes 111*b*.

By further tightening the bolt 13 in the above rotational position of the leg portions 122, each of the rotation inhibiting portions 123 is inserted into each of the engaging holes 111*b*, reducing the height from the base member 11 to the leg portions 122. Then, the bolt 13 is further tightened to be fastened so that the tips of the leg portions 122 move to a position at which the tips abut against the base member 11. This makes the rotation inhibiting portions 123 engage with the respective engaging holes 111*b*, and the fixing member 12 is fixed with respect to the base member 11 (antenna body 50). This state is defined as the main fixed state.

Figure 12:
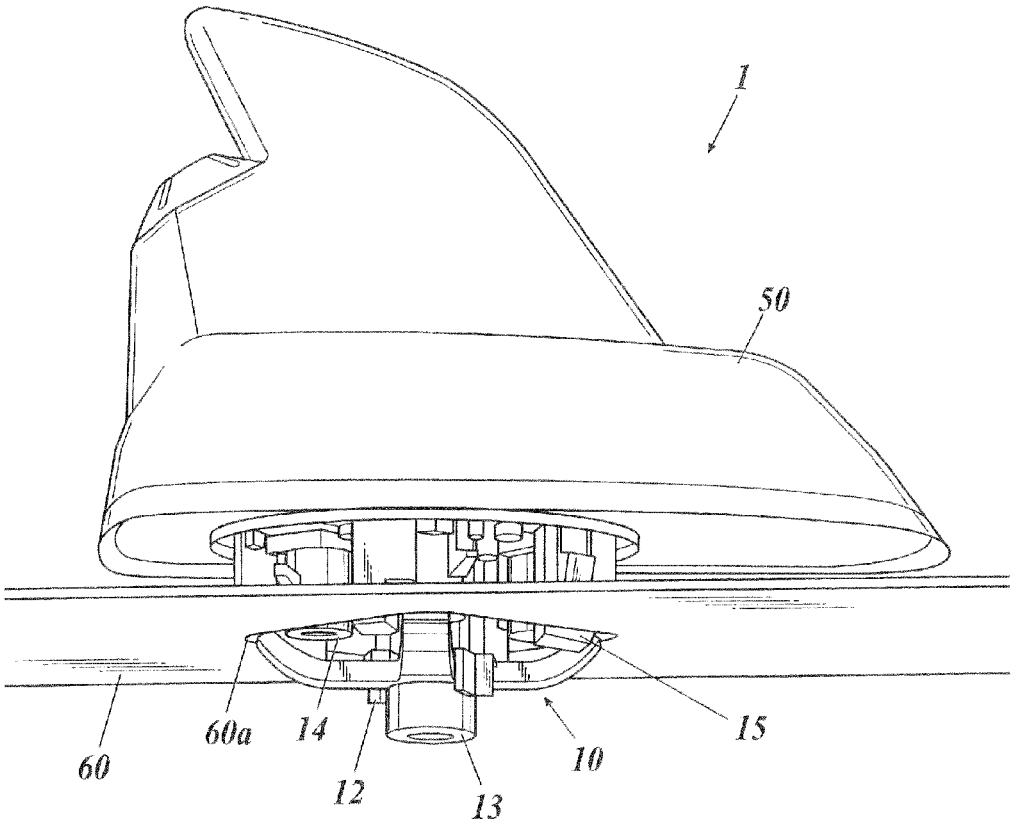
FIG. 12 is a view showing the antenna device in a state while the fixing device is being inserted into a fixing opening.
Figure 13:
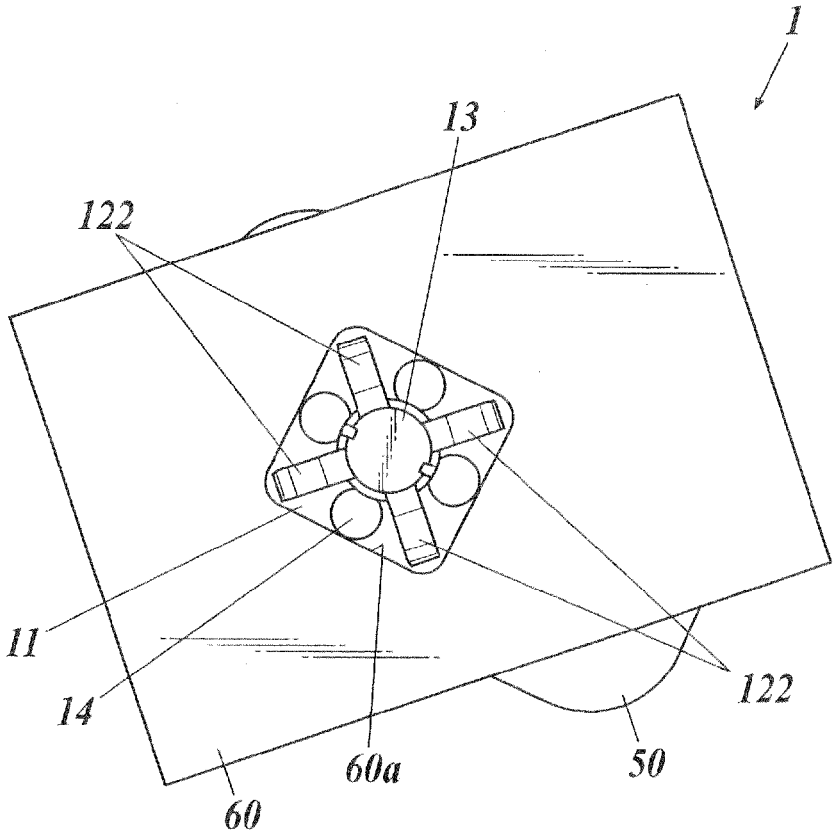
FIG. 13 is a view showing the antenna device in a state after the fixing device is inserted into the fixing opening.
Figure 14:
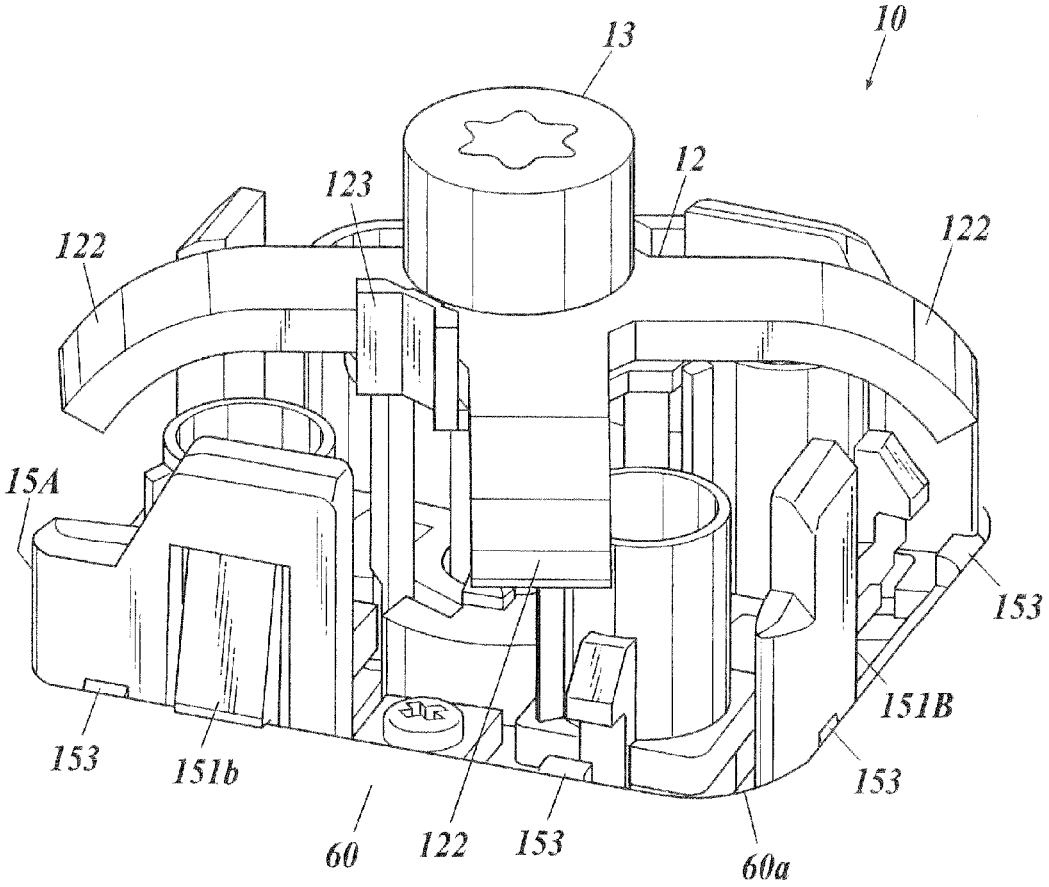
FIG. 14 is a perspective view of the fixing device when the fixing member is in the rotational state after the fixing device is inserted into the fixing opening.
Figure 15:
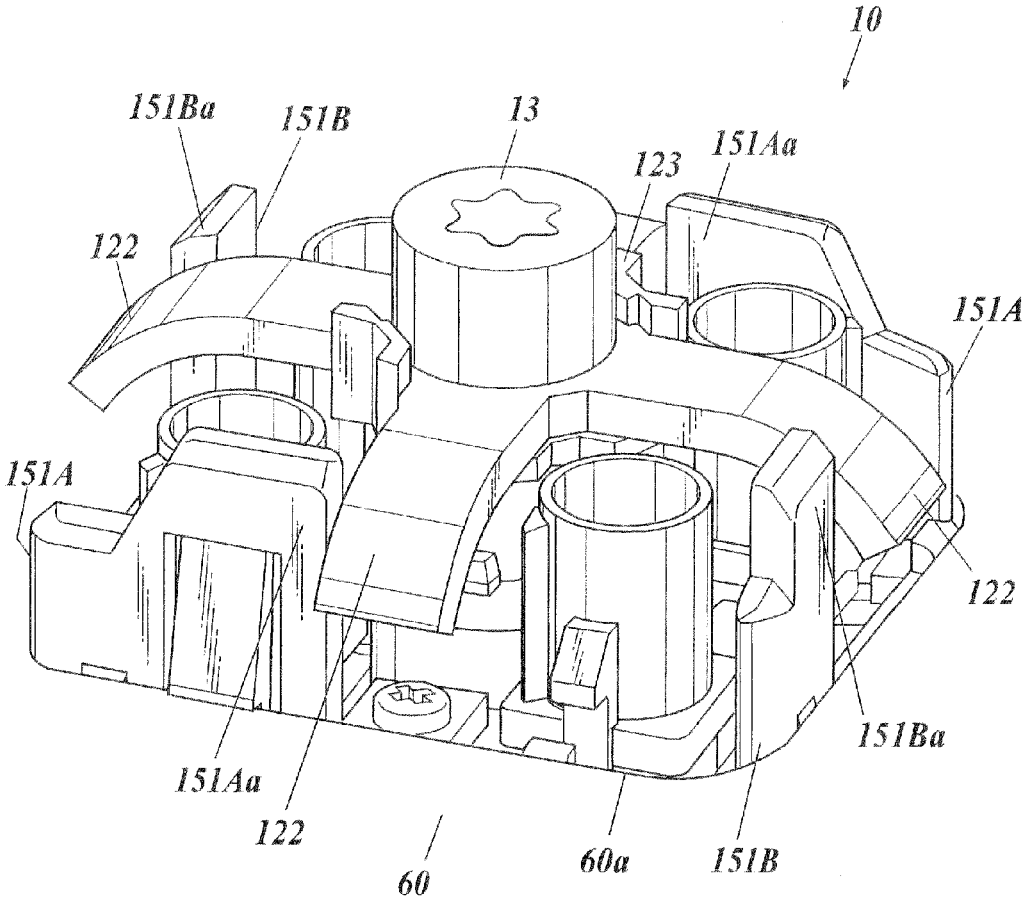
FIG. 15 is a perspective view of the fixing device when rotation of the fixing member is restricted by guide portions.
Figure 16:
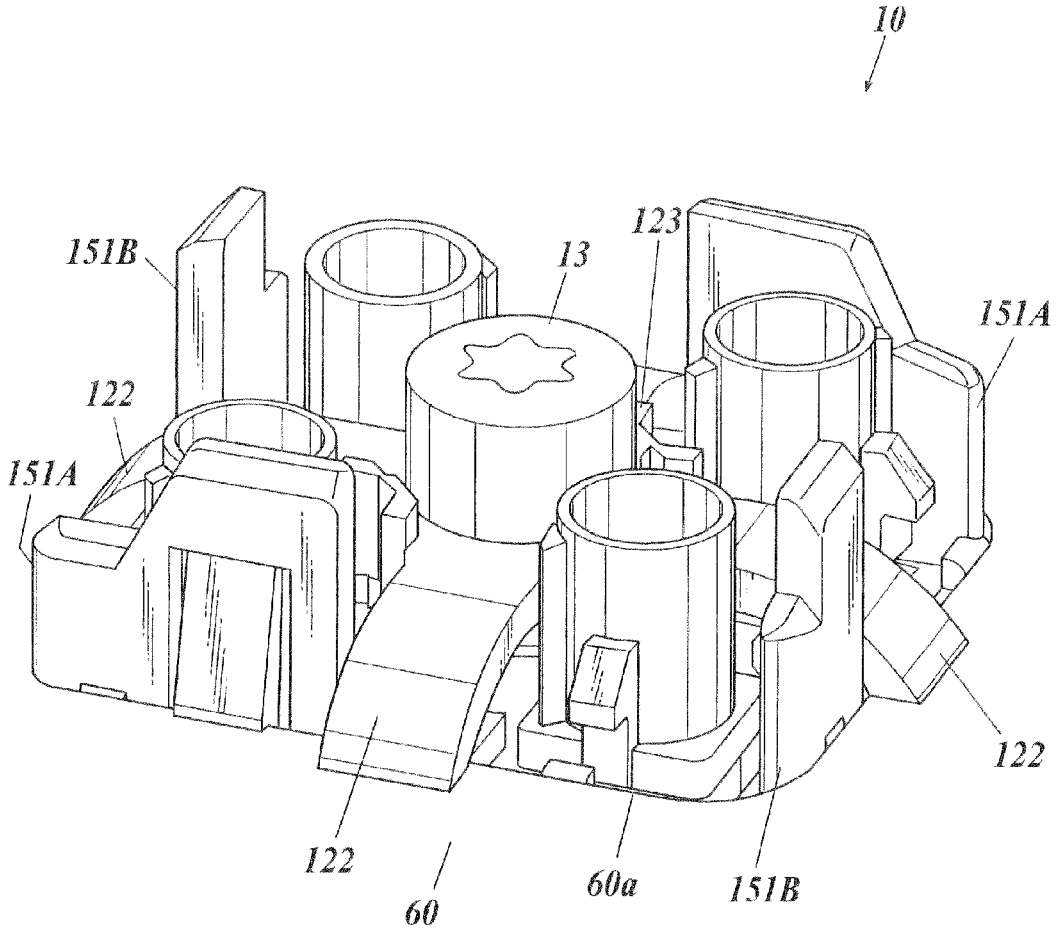
FIG. 16 is a perspective view of the fixing device in the main fixed state of being fixed onto the mounting surface.
Figure 17:
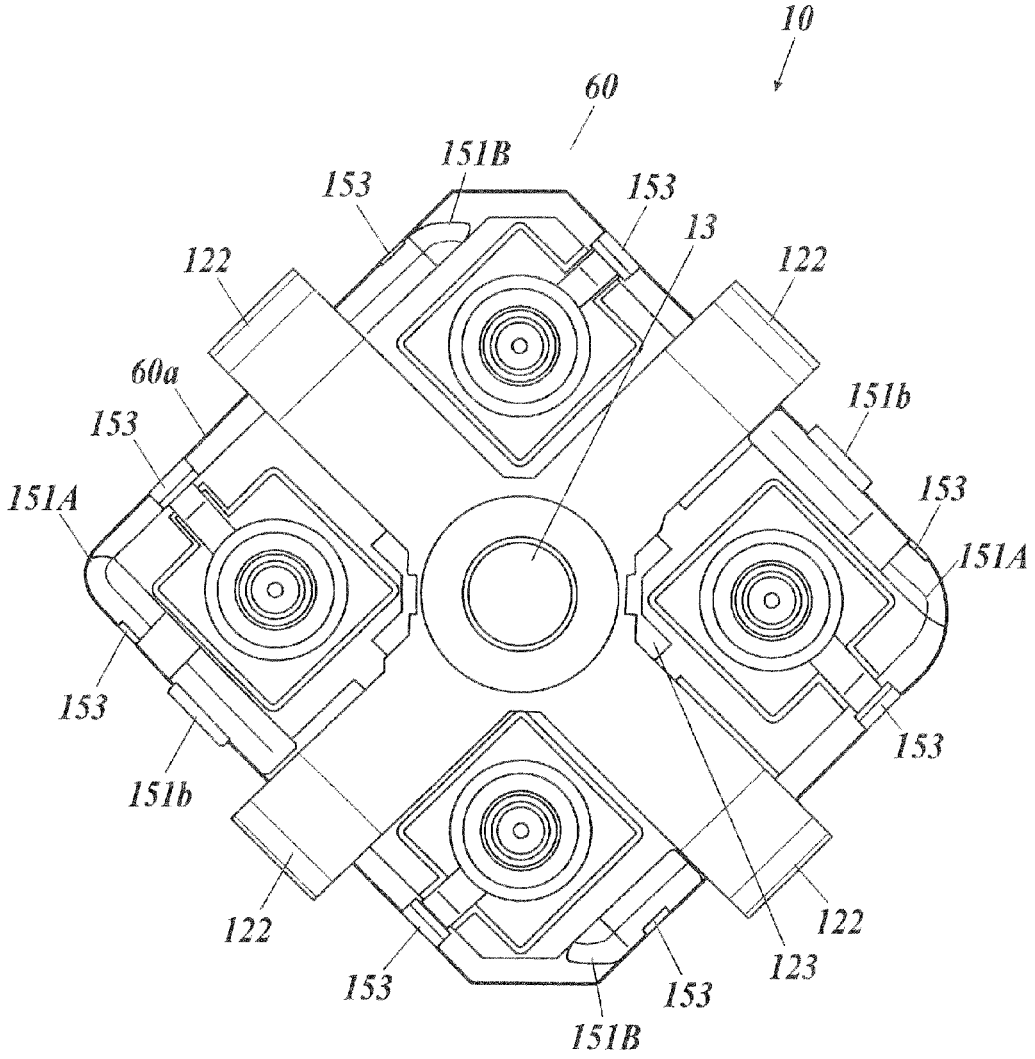
FIG. 17 is a plan view of the fixing device in the main fixed state of being fixed onto the mounting surface.

Next, a process of mounting the antenna device 1 (fixing device 10) onto the mounting surface 60 is described with reference to FIGS. 12 to 17. FIG. 12 is a view showing the antenna device 1 in a state while the fixing device 10 is being inserted into a fixing opening 60*a*. FIG. 13 is a view showing the antenna device 1 in a state after the fixing device 10 is inserted into the fixing opening 60*a*. FIG. 14 is a perspective view of the fixing device 10 when the fixing member 12 is in the rotational state after the fixing device 10 is inserted into the fixing opening 60*a*. FIG. 15 is a perspective view of the fixing device 10 when the rotation of the fixing member 12 is restricted by the guide portions 151A, 151B. FIG. 16 is a perspective view of the fixing device 10 in the main fixed state which is fixed onto the mounting surface 60. FIG. 17 is a plan view of the fixing device 10 in the main fixed state which is fixed onto the mounting surface 60.

First, the antenna device is set to the initial fixed state in which the fixing device 10 is attached to the antenna body 50 (corresponds to FIG. 8). Then, as shown in FIG. 12, the antenna device 1 in the initial fixed state is placed on the mounting surface 60 in a manner such that the leg portions 122 are respectively positioned on the diagonal lines of the fixing opening 60*a*, and the fixing member 12, the bolt 13, the connector portions 14 and the guide 15 are inserted into the fixing opening 60*a*. Here, the guide portions 151A, 151B and the projections 153 of the guide 15 are positioned at points corresponding to the respective sides of the fixing opening 60*a*. Therefore, as shown in FIG. 13, the base member 11 is guided by the guide portions 151A, 151B and the projections 153 and is inserted into the fixing opening 60*a*. During this insertion, the two hooks 151*b* protruded from the guide portions 151A, 151B are pushed in the insides of the guide portions 151A, 151B. This makes the insertion of the fixing device 10 (guide 15) into the mounting surface 60 smoothly. After inserting the fixing device 10 (guide 15) into the mounting surface 60, the hooks 151*b* protrude back again to clamp the mounting surface 60 (periphery of the fixing opening 60*a*) with the base member 11. In this manner, the antenna device 1 is temporary fixed by the hooks 151*b* onto the mounting surface 60.

As the guide 15 is made of resin which is softer than metal, an outer peripheral of the guide 15 can be formed into a shape with a small clearance in which gaps between the outer periphery of the guide 15 and the periphery of the fixing opening 60*a* are reduced. This prevents the antenna device 1 to be shifted in orientation and to become unsteady with respect to the mounting surface 60.

Furthermore, gaps between the guide 15 (guide portions 151A, 151B and connecting portion 152) and the periphery of the fixing opening 60*a* are covered by the projections 153. In this manner, the antenna device 1 is set to a fitted state such that the antenna device is positioned in a predetermined direction with respect to the mounting surface 60. The projections 153 further prevent the antenna device 1 from being shifted and becoming unsteady with respect to the mounting surface 60.

Next, when the bolt 13 is tightened to the nut portion 111 of the base member 11 by applying strong force in the tightening direction of the bolt 13 (clockwise) using the electric tools and the like, the fixing member 12 rotates in association therewith, and with the rotation, the protrusions 111*d* formed in the nut portion 111 or the recessions 123*a* formed in the rotation inhibiting portions 123 elastically deform and the locked state of the fixing device 10 is released. Thereafter, as shown in FIG. 14, the fixing member 12 of the fixing device 10 is set to the rotational state. Then the bolt 13 is further tightened, making the fixing member 12 rotate along the step portions 111*c* (corresponds to FIG. 9).

Then, as shown in FIG. 15, the guide portion bodies 151Aa, 151Ba restrict the rotation of the leg portions 122 of the fixing member 12 to stop the rotation of the fixing member 12. In this manner, the leg portions 122 of the fixing member 12 are positioned with respect to the base member 11.

With the bolt 13 being tightened further, the fixing member 12 moves towards the base member 11 side (mounting surface 60 side), so that the tips of the rotation inhibiting portions 123 are respectively inserted into the engaging holes 111*b*. As shown in FIGS. 16 and 17, by further tightening the bolt 13 to fasten the bolt 13 to the nut portion 111, each of the tips of the rotation inhibiting portions 123 engage with each of the engaging holes 111*b*. And the tips of the leg portions 122 abut against the periphery of the mounting surface 60, strongly press the periphery thereof and clamp the mounting surface 60 with the base member 11. The antenna device 1 (fixing device 10) is thus set to the main fixed state of being firmly fixed on the mounting surface 60.

As described above, according to the embodiment, the fixing device 10 of the antenna device 1 includes the base member 11, the fixing member 12, the bolt 13, and the guide 15. The fixing device 10 takes the main fixed state and the initial fixed state. In the main fixed state, the mounting surface 60 is clamped between the fixing member 12 and the base member 11 to fix the fixing device 10 after inserting the fixing device 10 into the fixing opening 60*a* and rotating the fixing member 12 at a predetermined angle. In the initial fixed state, the fixing member 12 is initially fixed with respect to the base member 11 before the fixing member 12 is rotated at the predetermined angle. The guide 15 is arranged at a position to surround the fixing member 12 in the initial fixed state, and includes the guide portions 151A, 151B which have greater height than that of the lower end of the fixing member 12 in the initial fixed state, regarding the height from the base member 11.

For this reason, the antenna device 1 can be firmly fixed onto the mounting surface 60 through the fixing opening 60*a* having a large aperture. Further, the guide portions 151A, 151B of the guide 15 prevent the initial fixed state of the fixing member 12 from being released by impact from the outside. And still further, in the initial fixed state, by preventing the periphery of the fixing opening 60*a* from getting caught between the guide 15 (guide portions 151A, 151B) and the fixing member 12, the antenna device can be easily mounted onto the mounting surface 60 (fixing opening 60*a*) and time taken for the mounting operation can be reduced. Here, the fixing opening 60*a* of the large aperture can be used, which enables wiring connections using the connector portions 14 as direct connectors.

Moreover, the fixing device 10 includes the bolt 13; the fixing member 12 includes the rotation inhibiting portions 123; and the base member 11 includes the nut portion 111, the engaging holes 111*b*, and the step portions 111*c* respectively having the protrusions 111*d*. When the fixing device 10 is in the initial fixed state, each of the recessions 123*a* engage with each of the protrusions 111*d* to set the fixing member 12 to the initial fixed state of being initially fixed, so that in the beginning of screwing of the bolt 13, the fixing member 12 is fixed and held in a manner such that the fixing member 12 abuts against the step portions 111*c*. The fixing device 10 is inserted into the fixing opening 60*a* in the initial fixed state, and the bolt 13 is tightened to the nut portion 111 and the fixing member 12 rotates in association therewith. By the rotation, the recessions 123*a* or the protrusions 111*d* elastically deform to release the initial fixed state (locked state), and after the fixing member 12 being rotated at a predetermined angle, the bolt 13 is fastened to engage each of the rotation inhibiting portions 123 with each of the engaging holes 111*b*. Then, the fixing member 12 is fixed and set to the main fixed state of clamping the mounting surface 60 with the base member 11.

As the rotation inhibiting portions 123 can restrict the fixing member 12 to rotate in association with the tightening of the bolt 13, mounting operation of the antenna device 1 becomes simple, and also, the mounting surface 60 can be securely clamped with the fixing member 12 (the tips of the leg portions 122 thereof) and the base member 11. Further, the position of the fixing member 12 (the leg portions 122 thereof) in the initial fixed state may be set differently from that at the time of clamping the mounting surface 60. Therefore, when inserting the leg portions 122 into the fixing opening 60*a*, a position of the antenna device 1 can be easily adjusted to face a predetermined direction. In other words, the antenna device 1 is positioned facing the predetermined direction from the beginning of the mounting operation, improving workability of the mounting operation. Still further, by only tightening the bolt 13, the fixing member 12 is released from the fixed (locked) state (initial fixed state) and held at the predetermined position after being rotated. This further improves the workability of the mounting operation.

The guide 15 is made of resin. This can prevent the antenna device 1 to be shifted in orientation and to become unsteady with respect to the mounting surface 60.

Further, the guide 15 includes the projections 153 which are provided on the outer periphery of the guide 15 and contact the inner side of the fixing opening 60*a* when mounting the antenna device 1 onto the mounting surface 60. This further prevents the antenna device 1 to be shifted and to become unsteady with respect to the mounting surface 60.

Still further, the guide portions 151A, 151B are respectively positioned at points to restrict the rotation of the fixing member 12 at the rotation position where each of the rotation inhibiting portions 123 is engaged with each of the engaging holes 111*b*. By this, the fixing member 12 can be easily stopped at the rotation position at which the fixing member 12 is finally abutted against the mounting surface 60.

Also, the fixing member 12 includes: the rotation axis portion 121 on which the insertion hole 121*a* is formed for inserting the bolt 13 therethrough; and the leg portions 122 which are extended radially from the rotation axis portion 121 where each of which is curved towards the base member 11. The length from the center of the rotation axis portion 121 to each of the tips of the leg portions 122 corresponds to the length from the center to each of the vertices of the fixing opening 60*a*. Thus, the curved shape of the leg portions 122 disperses the force applied by the leg portions 122 to the base member 11 in the vertical and horizontal directions with respect to the plane of the base member 11. This can prevent damaging and deforming of the mounting surface 60 by the tips of the leg portions 122 when mounting the fixing device 10 on the mounting surface 60.

The invention developed by the inventor is described based on the embodiment; however, the present invention is not limited to the above embodiment and can be altered without departing from the scope of the invention.

In the embodiment, the fixing opening formed on the mounting surface is formed in a substantially square shape, but the present invention is applicable to the one formed, for example, in a polygonal shape such as a triangle or rectangle, as long as the shape is not a circle. Moreover, there are no limitation in shapes, sizes, numbers and arranged positions regarding the structure for realizing the initial fixed state of the fixing member 12 (the protrusions 111*d* and the recessions 123*a*), as long as the structure works so that the engagement state is released by elastic deformation.

It should be noted that the above disclosed embodiment is only an example in all respects and not restrictive in any way. The scope of the invention is shown in the scope of the claims and not limited to the above embodiment. The present invention aims to include all alteration within the idea and scope of the invention.

The entire disclosure of Japanese Patent Application No. 2011-219561 filed on Oct. 3, 2011 including description, claims, drawings, and abstract are incorporated herein by reference in its entirety.

What is claimed is:

1. A fixing device for fixing an antenna device through a fixing opening provided on a mounting surface, comprising:

a base member;

a fixing member which has a shape that is inserted into the fixing opening and that is abutted against a periphery of the fixing opening; and a guide which guides the base member to the fixing opening, wherein the fixing device takes:

a main fixed state in which the mounting surface is clamped between the fixing member and the base member by means of inserting the fixing device into the fixing opening and rotating the fixing member at a predetermined angle; and an initial fixed state in which the fixing member is initially fixed with respect to the base member before the fixing member is rotated at the predetermined angle, and the guide is arranged at a position to surround the fixing member in the initial fixed state, and includes plural guide portions which have greater height than that of a lower end of the fixing member in the initial fixed state, regarding the height from the base member.

2. The fixing device according to claim 1, wherein the base member has a nut portion formed thereon, the fixing device includes a bolt which is screwed to the nut portion in a state such that the bolt is inserted into the fixing member, the fixing member includes rotation inhibiting portions which respectively have recessions on a periphery thereof and are shaped towards the base member, the base member includes: engagement holes each of which engages with each of the rotation inhibiting portions when the bolt is screwed to the nut portion; protrusions each of which engages with each of the recessions; and step portions each of which are connected to each of the engaging holes, in the initial fixed state, the fixing member is fixed and held in a manner such that the fixing member abuts against the step portions in a beginning of screwing the bolt to the nut portion in which the recessions engage with the protrusions, and the fixing device is inserted into the fixing opening in the initial fixed state, and when the bolt is tightened to the nut portion and the fixing member is rotated in association therewith, the recessions or the protrusions elastically deform to release the initial fixed state, and after the fixing member being rotated at the predetermined angle, each of the rotation inhibiting portions engage with each of the engaging holes by fastening the bolt, making the fixing member clamp the mounting surface with the base member and be fixed, and the fixing device is set to the main fixed state.

3. The fixing device according to claim 1, wherein the guide is made of resin.

4. The fixing device according to claim 1, wherein the guide includes plural projection portions which are provided on an outer periphery of the guide and contact an inner side of the fixing opening when the antenna device is mounted onto the mounting surface.

5. The fixing device according to claim 1, wherein the guide portions are arranged at positions that restrict a rotation of the fixing member at the predetermined angle.

6. The fixing device according to claim 1, wherein the fixing member has:

a rotation axis portion; and plural leg portions which are extended radially from the rotation axis portion and are respectively curved towards the base member, and length from a center of the rotation axis portion to each of tips of the leg portions corresponds to length from a center to each of vertices of the fixing opening.

7. An antenna device comprising:

the fixing device according to claim 1; and an antenna body.

* * * * *